US009956972B2

(12) United States Patent
Harp

(10) Patent No.: US 9,956,972 B2
(45) Date of Patent: May 1, 2018

(54) DETECTION OF DYNAMIC TRAIN-TO-RAIL SHUNTING PERFORMANCE

(71) Applicant: Siemens Industry, Inc., Alpharetta, GA (US)

(72) Inventor: Brian Harp, New Albany, IN (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 490 days.

(21) Appl. No.: 14/635,136

(22) Filed: Mar. 2, 2015

(65) Prior Publication Data

US 2016/0257320 A1 Sep. 8, 2016

(51) Int. Cl.

| | |
|---|---|
| ***B61L 13/00*** | (2006.01) |
| ***B61L 13/04*** | (2006.01) |
| ***B61L 1/20*** | (2006.01) |
| ***B61L 23/04*** | (2006.01) |
| ***B61L 27/00*** | (2006.01) |
| ***B61L 29/22*** | (2006.01) |

(52) U.S. Cl.

CPC ..... *B61L 13/002* (2013.01); *B61L 1/20* (2013.01); *B61L 13/005* (2013.01); *B61L 13/04* (2013.01); *B61L 23/041* (2013.01); *B61L 27/0088* (2013.01); *B61L 29/226* (2013.01)

(58) Field of Classification Search

CPC ..... B61L 13/002; B61L 13/04; B61L 13/005; B61L 23/24; B61L 29/28; B61L 29/284; B61L 29/286; B61L 29/18; B61L 29/22; B61L 29/228

USPC ..... 246/114 R, 247, 249

See application file for complete search history.

(56) References Cited

U.S. PATENT DOCUMENTS

| | | | | |
|---|---|---|---|---|
| 3,721,859 | A * | 3/1973 | Blanyer | B61L 1/10 246/249 |
| 3,725,699 | A * | 4/1973 | Pascoe | B61L 13/005 246/114 R |
| 4,256,278 | A * | 3/1981 | Sanville | B61K 9/06 246/169 D |
| 4,351,504 | A * | 9/1982 | Frielinghaus | B61L 1/165 246/122 R |

(Continued)

FOREIGN PATENT DOCUMENTS

| | | | |
|---|---|---|---|
| BE | 898751 | A1 | 5/1984 |
| FR | 2951262 | A1 | 4/2011 |
| WO | 2005120923 | A1 | 12/2005 |

OTHER PUBLICATIONS

PCT International Search Report dated May 23, 2016 corresponding to PCT International Application No. PCT/US2016018199 filed Feb. 17, 2016 (13 pages).

*Primary Examiner* — Zachary L Kuhfuss

(57) ABSTRACT

Systems and methods for detecting the dynamic train-to-rail shunting performance of a train as it is moving along the rails of a railroad track. The systems and methods use portable equipment temporarily installed at a site where it is desired to test the shunting of one or more trains or the electrical equipment installed at the track. The systems and method use sensor plates and a high speed recording system to simultaneously capture measured train-to-rail shunting characteristics and the positioning of a train's axles and any rail conditions impacting the measurements. The captured information can be used to fine tune the train, the electrical equipment installed at the track and/or to design new devices.

7 Claims, 3 Drawing Sheets

(56) References Cited

U.S. PATENT DOCUMENTS

| | | | | |
|---|---|---|---|---|
| 2006/0017583 | A1* | 1/2006 | Davenport | B61L 5/1881 340/641 |
| 2008/0169385 | A1* | 7/2008 | Ashraf | B61L 29/22 246/130 |
| 2010/0161255 | A1 | 6/2010 | Mian | |
| 2015/0022661 | A1 | 1/2015 | McSheffrey et al. | |
| 2015/0307118 | A1* | 10/2015 | Noffsinger | B61L 25/023 701/19 |

* cited by examiner

DETECTION OF DYNAMIC TRAIN-TO-RAIL SHUNTING PERFORMANCE

FIELD

Embodiments of the invention relate to the detection of the dynamic train-to-rail shunting performance of a train as it is moving along the rails of a railroad track.

BACKGROUND

A constant warning time device (often referred to as a crossing predictor or a grade crossing predictor in the U.S., or a level crossing predictor in the U.K.) is an electronic device that is connected to the rails of a railroad track and is configured to detect the presence of an approaching train and determine its speed and distance from a crossing (i.e., a location at which the tracks cross a road, sidewalk or other surface used by moving objects). The constant warning time device will use this information to generate a constant warning time signal for controlling a crossing warning device. A crossing warning device is a device that warns of the approach of a train at a crossing, examples of which include crossing gate arms (e.g., the familiar black and white striped wooden arms often found at highway grade crossings to warn motorists of an approaching train), crossing lights (such as the red flashing lights often found at highway grade crossings in conjunction with the crossing gate arms discussed above), and/or crossing bells or other audio alarm devices. Constant warning time devices are often (but not always) configured to activate the crossing warning device at a fixed time (e.g., 30 seconds) prior to an approaching train arriving at a crossing.

Typical constant warning time devices include a transmitter that transmits a signal over a circuit formed by the track's rails and one or more termination shunts positioned at desired approach distances from the transmitter, a receiver that detects one or more resulting signal characteristics, and a logic circuit such as a microprocessor or hardwired logic that detects the presence of a train and determines its speed and distance from the crossing. The approach distance depends on the maximum allowable speed of a train, the desired warning time, and a safety factor. Preferred embodiments of constant warning time devices generate and transmit a constant current AC signal on said track circuit; constant warning time devices detect a train and determine its distance and speed by measuring impedance changes caused by the train's wheels and axles acting as a shunt across the rails, which effectively shortens the length (and hence lowers the impedance) of the rails in the circuit. Multiple constant warning devices can monitor a given track circuit if each device measures track impedance at a different frequency.

Federal regulations mandate that a constant warning time device be capable of detecting the presence of a train as it approaches a crossing and to activate the crossing warning devices in a timely manner that is suitable for the train speed and its distance from the crossing. In addition, the device must be capable of detecting trains that approach the crossing from both sides of the crossing (e.g., from east to west and from west to east, north to south and south to north, etc.).

In recent years, the North American rail industry has seen an increased number of events in which constant warning time devices have not performed as expected. Although the exact root cause of the events cannot be determined, it appears that the events are based on the rail vehicle (e.g., a train) not presenting a 0.06 ohm shunt between the lead axles of the train and the rail surface. All AREMA (American Railway Engineering and Maintenance-of-Way Association) based equipment and FRA (Federal Railroad Administration) testing is based on those values. The events appear more often for newer, faster and lighter passenger trains, which present a different effective shunt than standard freight trains.

Moreover, there are a number of changes in railroad operations that have led to the potential for a "dirtier" rail than in the past such as e.g., (1) more use of rail lubricants to reduce wheel and rail wear; (2) increased use of dynamic braking for train speed control instead of air brakes, which reduces the amount of time that the brake shoes can contact the wheel treads and scrub off any dirt or contamination collected on the wheel; (3) increased use in the rail passenger fleet of the use of disc braking systems that do not provide a scrubbing action on the wheel tread that contacts the rail; and (4) changes in the compounds used to make up the brake shoes themselves and changes in the metallic structure of the rail itself.

Currently, there is no system that is capable of determining the shunting characteristics of a moving train or other rail vehicle. Being able to determine the correct value of an effective shunt, specifically for certain types of passenger trains, can lead to optimizing the performance of the crossing warning time device when it is presented with a shunt value that does not meet the 0.06 ohm standard. Thus, there is a need and desire for a technique for detecting the dynamic train-to-rail shunting performance of a train as it is moving along the rails of a railroad track.

DETAILED DESCRIPTION

In designing signal products (e.g., constant warning time devices) where a detection mechanism is based on a rail vehicle (e.g., a train) presenting a certain shunt value across the rails through the lead wheels and axle of the train, the determination of that minimum detectable shunt value becomes critical to the correct design of the product. Embodiments disclosed herein provide a portable, quick, efficient, accurate and inexpensive system and method for detecting the dynamic train-to-rail shunting performance, which can be used to ensure that these products will function properly.

Figure 1:
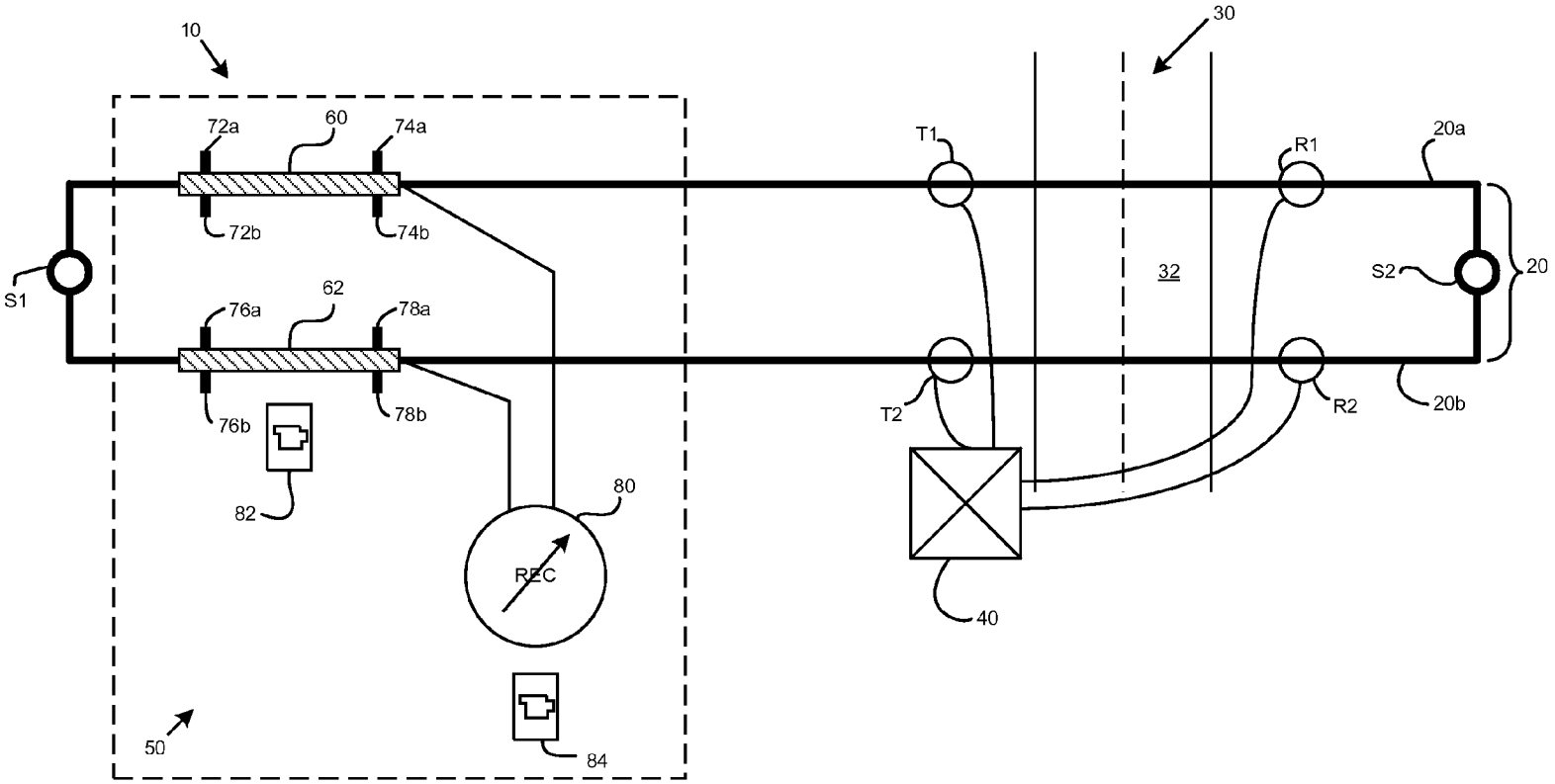
FIG. 1 illustrates an example track system constructed in accordance with an embodiment disclosed herein that is capable of detecting the dynamic train-to-rail shunting performance of a train as it is moving along the rails of a railroad track.

FIG. 1 illustrates a railroad track system 10 in accordance with a disclosed embodiment. The railroad track system 10 is provided at a location in which a road 30 crosses a railroad track 20. The crossing of the road 30 and track 20 forms an island 32. The railroad track 20 includes two rails 20*a*, 20*b* and a plurality of ties (not shown in FIG. 1) that are provided over and within railroad ballast (not shown in FIG. 1) to support the rails.

The system 10 includes a constant warning time device 40 that comprises a transmitter (not shown) that connects to the rails 20*a*, 20*b* at transmitter connection points T1, T2 on one side of the road 30. The constant warning time device 40 also comprises a receiver (not shown) that connects to the rails 20*a*, 20*b* at receiver connection points R1, R2 on the other side of the road 30. Those of skill in the art will recognize that the transmitter and receiver, other than the physical conductors that connect to the track 20, are often co-located in an enclosure located on one side of the road 30. The constant warning time device 40 includes a control unit (not shown) connected to the transmitter and receiver. The control unit includes logic (which may be implemented in hardware, software, or a combination thereof) for calculating train speed, distance and direction, and producing constant warning time signals for the crossing.

Also shown in FIG. 1 are a pair of termination shunts S1, S2, one on each side of the road 30 at a desired distance from the center of the island (e.g., 3000 feet). It should be appreciated that FIG. 1 is not drawn to scale and that the second shunt S2 is approximately the same distance away from the center of the island 32 as the first shunt S1 is.

Typically, in existing track circuits, the shunts positioned on both sides of the road and their associated constant warning time device are tuned to the same frequency. This way, the transmitter can continuously transmit one AC signal having one frequency, the receiver can measure the voltage response of the rails and the control unit can make impedance and constant warning time determinations based on one specific frequency. When a train crosses one of the termination shunts, the train's wheels and axles act as shunts, which lowers the inductance, impedance and voltage measured by the corresponding control unit. Measuring the change in the impedance indicates the distance of the train, and measuring the rate of change of the impedance (or integrating the impedance over time) allows the speed of the train to be determined.

The system 10 also includes a shunt performance detection system 50 located on one side of the track 20. In the illustrated embodiment, the shunt performance detection system 50 is located on the left side of the island 32 between the first shunt S1 and transmitter connection points T1, T2, but is should be appreciated that the system 50 could be located on the right side of the island 32 between the second shunt S2 and receiver connection points R1, R2, if desired. In fact, the shunt performance detection system 50 is portable (i.e., not permanently installed) and can be installed at any point between the two shunts S1, S2.

The shunt performance detection system 50 comprises a first sensor plate 60 connected to at least the top portion of the first rail 20*a* by clamping devices 72*a*, 72*b*, 74*a*, 74*b*. In FIG. 1, clamping devices 72*a*, 74*a* are located on the field side of the first rail 20*a* while clamping devices 72*b*, 74*b* are located on the gauge side of the first rail 20*a*. The system 50 also comprises a second sensor plate 62 connected to at least the top portion of the second rail 20*b* by clamping devices 76*a*, 76*b*, 78*a*, 78*b*. In FIG. 1, clamping devices 76*a*, 78*a* are located on the gauge side of the second rail 20*b* while clamping devices 76*b*, 78*b* are located on the field side of the second rail 20*b*.

In one embodiment, the sensor plates 60, 62 are the same size as each other and are positioned directly across from each other as shown in FIG. 1. In one embodiment, the sensor plates 60, 62 are approximately eighteen inches in length (or less) so that there will never be more than one wheel/axle set in contact with the system 50 at any one time. As discussed below with reference to FIG. 2, each sensor plate 60, 62 comprises a soft metal sheet that can be wrapped around at least a top portion of the respective rails 20*a*, 20 and an insulating material located between the metal sheets and the rails.

The sensor plates 60, 62 are connected to a recording meter 80 positioned away from the vibration of the track 20 so as not to disturb the calibration of the meter 80. In one embodiment, the recording meter 80 is a recording ohmmeter or micro-ohmmeter capable of measuring small impedances such as e.g., 0.06 ohms as mentioned above. In the illustrated embodiment, a high speed digital camera 82 is positioned next to the track 20 and set up to capture a train's axles as they cross the sensor plates 60, 62. High speed digital cameras in today's market often record and store video images at 1,000 frames per second. The images can then be played back in slow and stop motion to aid in seeing what was recorded. Playback can occur on the cameras themselves or the images can be downloaded on one or more devices such as e.g., a computer, laptop, tablet, etc. and then played-backed on the one or more device. The illustrated embodiment includes a second high speed digital camera 84 positioned next to the meter 80 and set up to capture the display of the meter 80 at the same time that the first camera 82 is capturing the train's axles crossing the sensor plates 60, 62.

As will be explained below in more detail with respect to FIG. 3, the two cameras 82, 84 simultaneously capture and store a plurality of images to allow for the correlation between the axle, its position along the sensor plates 60, 62 and the effective value of the shunt presented to the system 50 as measured by the meter 80. In essence, the cameras 82, 84 form a capturing system for the system 50. Playback of the recorded image data will be used for determining the general trending of how the shunt changes when field conditions such as e.g., operating speed, brake application or weather conditions are varied. It should be appreciated, however, that if the recording meter 80 has more intelligence such as e.g., a capability to output substantially all of its measurements to a computer, laptop or other device over the period that the first digital camera is capturing the images of the axles, then the second camera 82 would not be required. Instead, the images from the first camera 82 would be compared to the meter's 80 output data using the computer, laptop, etc.

Figure 2:
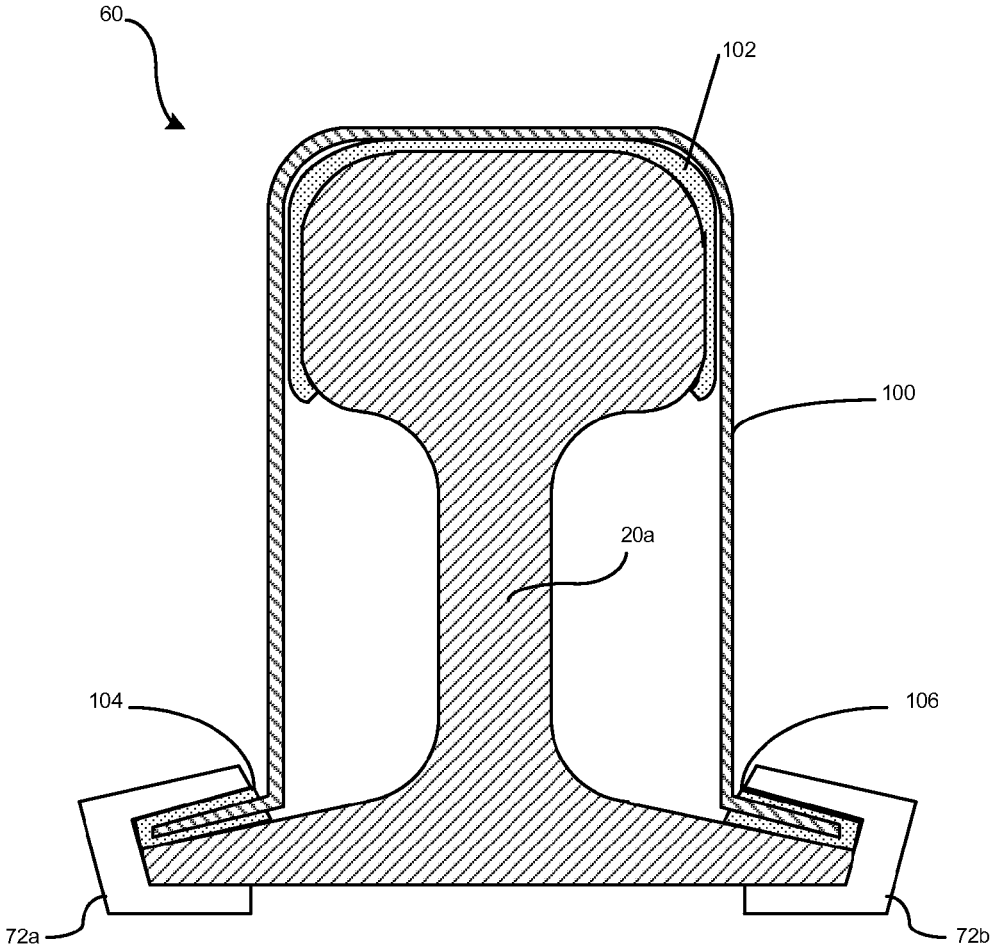
FIG. 2 illustrates a cross-sectional view of one end of an example rail mounted sensor plate used in the FIG. 1 system and constructed in accordance with an embodiment disclosed herein.

FIG. 2 illustrates a cross-sectional view of one end of an example rail mounted sensor plate 60 used in the FIG. 1 system 10 and constructed in accordance with an embodiment disclosed herein. It should be appreciated that the other end of the plate 60 will have the same construction (the lone exception being the use of clamping devices 74*a*, 74*b* on that end as shown in FIG. 1). It should also be appreciated that second sensor plate 62 of FIG. 1 would be constructed in the same manner (again, the exceptions being the use of clamping devices 76*a*, 76*b*, 78*a*, 78*b* on the respective ends of the plate 62).

The illustrated sensor plate 60 comprises a soft metal sheet 100 that can be wrapped around at least the top portion of the rail 20*a*. In one embodiment, the metal sheet 100 is a thin aluminum sheet. It should be appreciated, however, that the embodiments disclosed herein are not limited to aluminum and that any soft, malleable metal sheet can be used. As shown in FIG. 2, insulating material 102, 104, 106 is located on the rail 20*a* at locations where the metal sheet 100 would contact the rail 20*a*. The insulating material is used so that the resistance of the track's structure and ballast do not adversely impact the measurements made by the system 50. It should be appreciated that any suitable insulating material can be used in the plate 60. As shown in FIG. 2, the metal sheet 100 and insulating material 102, 104, 106 comprising the sensor plate 60 are anchored to the rail 20*a* using clamping devices 72*a*, 72*b*. In one embodiment, the clamping devices are spring clamps of the kind that are often used to connect components to railroad tracks.

Figure 3:
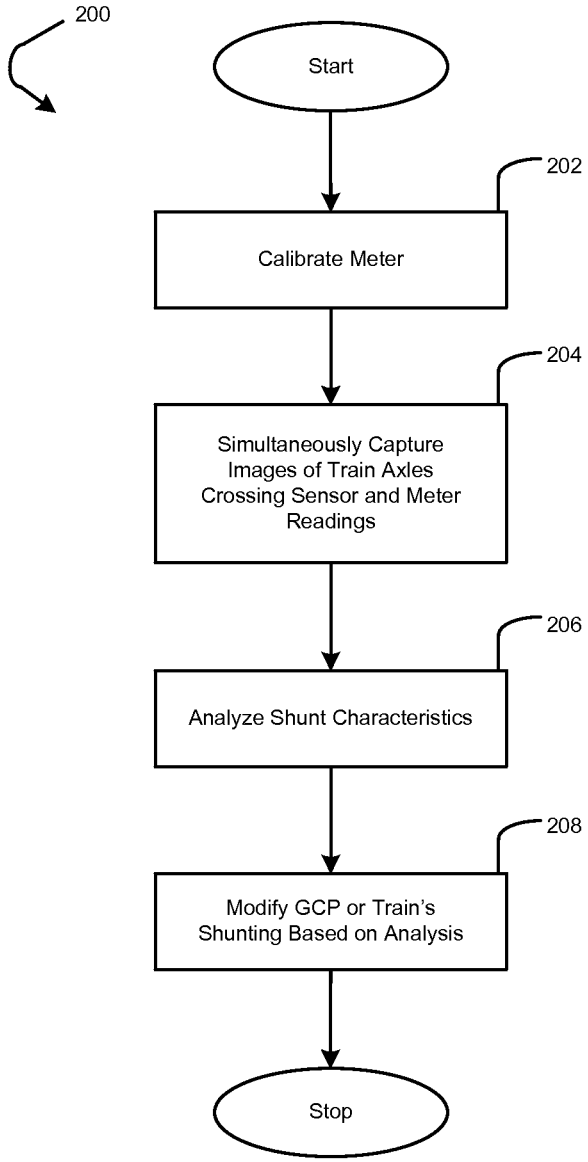
FIG. 3 illustrates an example method of detecting the dynamic train-to-rail shunting performance of a train performed in accordance with an embodiment disclosed herein.

FIG. 3 illustrates an example method 200 of detecting the dynamic train-to-rail shunting performance of a train performed in accordance with an embodiment disclosed herein. When the shunt performance detection system 50 is placed into service, the two sensor plates 60, 62 will be brought into contact with each other and the meter 80 will be zeroed out to account for all of the built-in resistance of the wiring that connects the sensor plates 60, 62 to the ohmmeter 80 (step 202).

The sensor plates 60, 62 will be attached to the rails 20*a*, 20*b* of the track 20 and trains will be operated over the system 50 with the meter 80 logging the effective shunting values that are being seen by the plates 60, 62. In the embodiment illustrated in FIG. 1, the first high speed digital camera 82 captures and stores a plurality of images (e.g., at a 1,000 fps rate) of the train's axles as they cross the sensor plates 60, 62 while the second high speed digital camera 84 captures and stores a plurality of images of the meter's 80 display (e.g., at a 1,000 fps rate) at step 204. At this point, the images can be played back, preferably simultaneously, to analyze the train-to-rail shunting characteristics in comparison to the actual positioning of the axles over the sensor plates 60, 62 (step 206). That is, the shunting characteristics are correlated to the positioning of the axles and any operating conditions at the time. It should be appreciated that standard playback techniques, such as stop motion or slow motion playback can be used to observe the shunting performance at specific times and at specific positioning of the axles.

The observed behavior and impedance measurements can be used to modify the crossing warning time device and/or the train's shunting as appropriate (step 208). As mentioned above, the method 200 can be repeated for different trains, operations of the trains, and different conditions of the track, which will also aid in analyzing the train and constant warding time device.

As can be appreciated, the disclosed embodiments provide several advantages over existing railroad systems. Initially, it should be appreciated that the disclosed embodiments will be able to determine dynamic train-to-rail shunting performance is a relatively easy and highly accurate manner. Because the disclosed shunt performance detection system 50 is portable and non-destructively connected to the rails, the system 50 could be set up at a specific customer field location to test customer trains and constant warning time devices under their normal operating conditions. It should be appreciated, however, that if more detailed analysis is desired, the system 50 could be set up at a testing facility such as e.g., the AAR (Association of American Railroads)/TTC (Transportation Technology Center) testing center in Pueblo, Colo. The testing center could include a loop track that would allow for repeated testing of a train and constant warning time devices, with changes being made between test runs, without having to relocate the system 50 or components of the system 50.

Moreover, the ability to know a rail vehicle's shunting performance will allow railroad personnel to more accurately design new products that maximize the performance of the systems they will be used in. The ability to know a rail vehicle's shunting performance will also allow for the optimization of existing equipment to work in those same electrical environments, which should lead to a decrease in the number of field failures.

The foregoing examples are provided merely for the purpose of explanation and are in no way to be construed as limiting. Further areas of applicability of the present disclosure will become apparent from the detailed description, drawings and claims provided hereinafter. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

What is claimed is:

1. A railroad system comprising:

a first sensor plate connected to a top portion of a first rail of a railroad track;

a second sensor plate connected to a top portion of a second rail of the railroad track, the second sensor plate being located across from the first sensor plate;

a measurement device adapted to measure a characteristic associated with a train traveling over the first and second sensor plates; and a capturing system configured to capture images of a portion of the train as the train is traveling over the first and second sensor plates and simultaneously capture measurements of the characteristic as the train is traveling over the first and second sensor plates, wherein the characteristic comprises a train-to-rail shunt impedance.

2. The system of claim 1, wherein the portion of the train comprises the train's axles.

3. The system of claim 1 wherein the capturing system is configured to capture the images and the measurement for an entire period that the train is traveling over the first and second sensor plates.

4. The system of claim 3, further comprising a device for displaying the captured images and measurements so that the characteristic's performance can be analyzed over the period by correlating the measurements to positions of the portion of the train over the first and second rails.

5. The system of claim 1 wherein the capturing system comprises:

a first digital camera adapted to capture images of the portion of the train; and a second digital camera adapted to capture measurements of the characteristic.

6. A railroad system comprising:

a first sensor plate connected to a top portion of a first rail of a railroad track;

a second sensor plate connected to a top portion of a second rail of the railroad track, the second sensor plate being located across from the first sensor plate;

a measurement device adapted to measure a characteristic associated with a train traveling over the first and second sensor plates; and a capturing system configured to capture images of a portion of the train as the train is traveling over the first and second sensor plates and simultaneously capture measurements of the characteristic as the train is traveling over the first and second sensor plates, wherein the measurement device comprises a recording ohmmeter.

7. The system of claim 6, wherein the capturing system comprises:

a first digital camera adapted to capture images of the portion of the train; and a device coupled to the recording meter and being adapted to capture the measurements from the ohmmeter.

* * * * *